US008096848B2

(12) United States Patent
Hollis

(10) Patent No.: US 8,096,848 B2
(45) Date of Patent: Jan. 17, 2012

(54) COLLAPSIBLE TOY AIRPLANE

(76) Inventor: John Rey Hollis, Albany, CA (US)

( * ) Notice: Subject to any disclaimer, the term of this patent is extended or adjusted under 35 U.S.C. 154(b) by 213 days.

(21) Appl. No.: 12/471,235

(22) Filed: May 22, 2009

(65) Prior Publication Data

US 2010/0136873 A1 Jun. 3, 2010

Related U.S. Application Data

(60) Provisional application No. 61/055,192, filed on May 22, 2008.

(51) Int. Cl.
*B64C 1/00* (2006.01)

(52) U.S. Cl. ..... 446/62

(58) Field of Classification Search ..... 446/62, 446/109, 487
See application file for complete search history.

(56) References Cited

U.S. PATENT DOCUMENTS

| | | | | |
|---|---|---|---|---|
| 1,947,392 | A | 2/1934 | Guntermann et al. | |
| 3,065,799 | A | 11/1962 | McCarty, Jr. | |
| 3,213,573 | A | 10/1965 | Bohr et al. | |
| 3,300,910 | A | 1/1967 | Isaac | |
| 3,670,773 | A | 6/1972 | Guerster | |
| 3,744,741 | A * | 7/1973 | Christian et al. | 244/16 |
| 4,292,757 | A | 10/1981 | Cahen, Jr. | |
| 4,307,536 | A | 12/1981 | English et al. | |
| 4,485,991 | A | 12/1984 | Fuller | |
| 4,655,720 | A * | 4/1987 | Renger et al. | 446/61 |
| 4,742,977 | A * | 5/1988 | Crowell | 244/123.1 |
| 4,836,817 | A | 6/1989 | Corbin | |
| 5,391,106 | A | 2/1995 | Lidert, Jr. | |
| 5,525,087 | A * | 6/1996 | Chin-Lin | 446/59 |
| 5,658,037 | A | 8/1997 | Evans et al. | |
| 5,816,880 | A | 10/1998 | Forti et al. | |
| 5,947,785 | A | 9/1999 | Bausch | |
| 6,135,388 | A * | 10/2000 | Hostetter | 244/153 R |
| 6,290,178 | B1 * | 9/2001 | Wang | 244/153 R |
| 6,437,232 | B1 | 8/2002 | Dailey et al. | |
| 6,443,793 | B1 | 9/2002 | Huebl et al. | |

FOREIGN PATENT DOCUMENTS

| | | |
|---|---|---|
| GB | 2161775 | 5/2009 |

* cited by examiner

*Primary Examiner* — Gene Kim
*Assistant Examiner* — Amir Klayman
(74) *Attorney, Agent, or Firm* — O'Connell Law Firm

(57) ABSTRACT

A collapsible toy airplane reconfigurable between storage and use configurations. At least one spar member forms first and second wings and is coupled to a fuselage. The main body member and the at least one spar are formed from spring steel with an arcuate cross section whereby they can be reconfigured from a straight, substantially rigid disposition to a coiled configuration. A sheath of flexible material envelops the at least one spar member. The at least one spar member can be pivotable from a use configuration forming the first and second wings to a collapsed configuration substantially in-line with the main body member. The wings can be formed from first and second spar members, each pivotally coupled to the main body portion and each adjustable from a use configuration disposed at a dihedral angle to a collapsed, in-line configuration.

14 Claims, 11 Drawing Sheets

COLLAPSIBLE TOY AIRPLANE

FIELD OF THE INVENTION

The present invention relates generally to flying toys. More particularly, disclosed and protected herein is a toy airplane with flexible wing and body members that is nondestructively and repeatedly reconfigurable between storage and use configurations while providing sufficient rigidity to maintain structural integrity during play and, potentially, flight and possessing sufficient resiliency in certain embodiments to snap into form automatically upon being tossed or released.

BACKGROUND OF THE INVENTION

Toy airplanes are enjoyed by children and adults alike. Numerous airplane constructions have been disclosed by the prior art, from very simple constructions to elaborate replicas of full-sized planes. Toy airplanes can be merely ornamental in nature or designed for flight, whether by being hand-launched, shot with a sling, flown with a motor, or otherwise launched or powered.

However, many toy airplanes are not reconfigurable between collapsed and use configurations. The bodies or fuselages of prior art toy airplanes are commonly made of relatively rigid materials, such as plastic or balsa wood. These materials do not allow for the structure itself to bend and collapse. Consequently, once the airplane is fully assembled, packaging, transportation, and storage requirements demand space corresponding to the full length and width of the airplane.

Toy airplanes with knockdown frame structures have been disclosed. Such structures advantageously achieve a reduced overall size when disassembled or otherwise reconfigured that facilitates portability and storage. For example, some airplanes have separable wing and fuselage portions. Other toy airplanes have wings that can be pivoted or folded adjacent to a storage position adjacent to the fuselage. However, even in these constructions, the fuselage and the wings typically remain rigid even where the structure is reconfigured to a storage configuration. Consequently, the storage and transportation capabilities of the airplane remain limited.

Of course, it will be appreciated that paper airplanes, indeed many types of toy airplanes, can be reconfigured from a use configuration to a collapsed configuration. However, doing so effectively requires the destruction of the airplane. For example, in the case of the paper airplane, one can readily collapse the structure by crushing the paper body and wings, but doing so renders the airplane unusable.

In view of the foregoing, it will be appreciated that a toy airplane capable of being nondestructively and repeatably reconfigured between storage and use configurations that, where necessary, demonstrates sufficient rigidity when in a use configuration to permit play activities and, potentially, flight would represent a useful advance in the art.

SUMMARY OF THE INVENTION

Advantageously, the present invention is founded on the basic object of providing a toy airplane that can be nondestructively and repeatedly reconfigured between storage and use configurations.

A further object of embodiments of the invention is to provide a toy airplane that demonstrates sufficient rigidity when in a use configuration to permit play activities and, potentially, flight.

In certain embodiments, a further object of the invention is to provide a collapsible toy airplane that can pursue widely plane shapes, sizes, dimensions, and designs.

Another object of particular embodiments of the invention is to provide a collapsible toy airplane that incorporates materials that are sufficiently flexible to permit coiling of the fuselage and wing sections when desired for storage while demonstrating sufficient durability and rigidity to permit uncoiling to a rigid use configuration.

A further object of the invention is to provide a toy airplane can be reconfigured between storage and use configurations easily and without a need for tools.

Yet another object of the invention is to provide a toy airplane that can be collapsed to a relatively small configuration in comparison to prior art disassemblable and reconfigurable airplanes.

These and further objects and advantages of embodiments of the invention will become obvious not only to one who reviews the present specification and drawings but also to one who has an opportunity to make use of an embodiment of the instant invention for a collapsible toy airplane disclosed herein. The accomplishment of each of the foregoing objects in a single embodiment of the invention may be possible and indeed preferred. However, it will be appreciated that not all embodiments will seek or need to accomplish each and every potential object and advantage. Nonetheless, all such embodiments should be considered within the scope of the present invention.

In a basic embodiment of the invention, the collapsible toy airplane is formed with a fuselage comprising an elongate main body member with a forward end, an aft end, and a body portion. First and second wings are coupled to the fuselage. Each wing has a proximal end and a distal end, and the first and second wings can be formed by a single spar member or separate spar members. At least one of and potentially both the main body member and the at least one spar member can be reconfigurable between a first, use configuration and a second, coiled configuration.

To permit the reconfiguration between the use configuration and the coiled configuration, the main body member and potentially the at least one spar member forming the wings can be formed of a spring material, such as spring steel. The main body member and the at least one spar member can have an arcuate cross section for providing structural rigidity when in a use configuration and for permitting coiling to the coiled, storage configuration.

To provide aerodynamic performance to the airplane, a sheath of flexible material can at least partially envelop the at least one spar member. In such an embodiment, a drawstring can have a first end coupled to the at least one spar member, a body portion that passes within the sheath of flexible material, and a second end that extends beyond the sheath of flexible material so that the drawstring can be pulled to induce a coiling of the spar member.

In certain embodiments, tip members, which can be rigid or semi-rigid, can be removably and replaceably retained relative to the distal ends of the first and second wings for enabling an adjustment of side-to-side balance in the collapsible toy airplane. Likewise, a nose member can be removably and replaceably retained relative to the forward end of the fuselage for enabling adjustment of forward to aft balance in the airplane.

To facilitate the collapsing and storage of the airplane, the at least one spar member can be pivotable in relation to the main body member, such as from a use configuration wherein the at least one spar member forms the first and second wings to a collapsed configuration wherein the at least one spar member is substantially in-line with the main body member. In particular embodiments, the first and second wings can be formed from first and second spars with each of the first and second spars having a proximal end and a distal end and each of the first and second spars pivotally coupled to the main body portion.

The aerodynamic performance of the toy airplane can be further improved by having the first and second spars disposed at a dihedral angle relative to the body portion when in a use configuration. In one exemplary embodiment, this can be accomplished by having the first and second spars pivotally coupled to the main body portion by a base plate that has a mid-portion coupled to the main body portion, a first outboard end pivotally coupled to the first spar member, and a second outboard portion pivotally coupled to the second spar member. The dihedral angle can be achieved, at least in part, by upturning the first and second ends of the base plate, and the adjustment from the dihedral angle to the in-line disposition can be facilitated by forming a rearward bend in each of the first and second outboard ends of the base plate and the proximal ends of the first and second spars. Still further, a sheath of flexible material can at least partially envelop the nose and can retain the nose in a downturned configuration while the airplane is in a use configuration thereby to provide aerodynamic and gravitational stability to the airplane.

One will appreciate that the foregoing discussion broadly outlines the more important features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
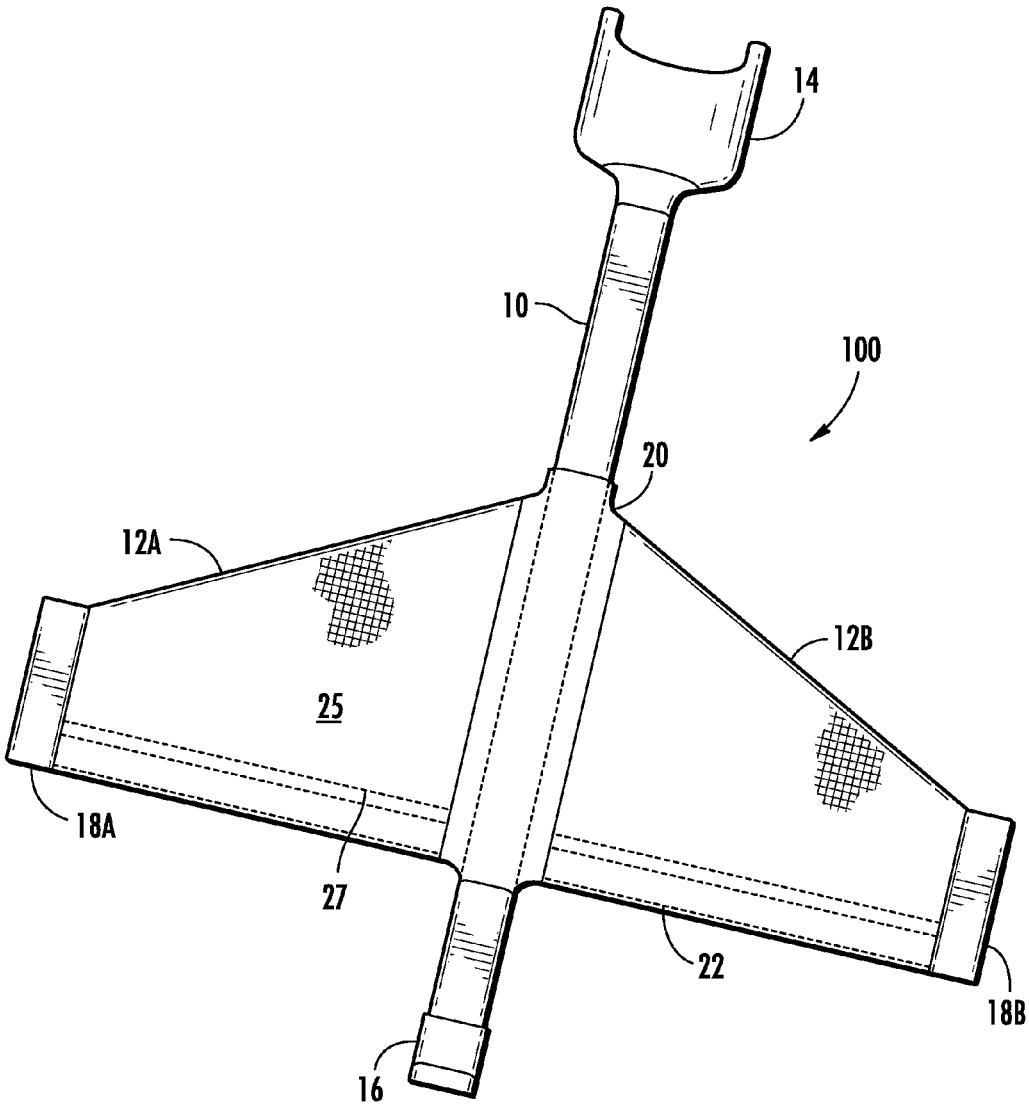
FIG. 1 is a perspective view of a collapsible toy airplane according to the present invention in a use configuration.

It will be appreciated that the collapsible toy airplane disclosed herein is subject to widely varied embodiments. However, to ensure that one skilled in the art will be able to understand and, in appropriate cases, practice the present invention, certain preferred embodiments of the broader invention revealed herein are described below and shown in the accompanying drawing figures.

Looking more particularly to the drawings, a collapsible toy airplane pursuant to the present invention is indicated generally at 100 in FIGS. 1 through 6. There, the airplane 100 can be seen to be founded on a body member 10 that has transversely disposed wings 12A and 12B coupled to an aerodynamically sound mid-portion thereof. The body member 10 is long and narrow and, in certain embodiments, can resemble an airplane fuselage or, theoretically, any other structure, such as a toy figure.

A spar 22 is retained perpendicularly to the body member 10. The spar 22 can, in certain embodiments, be disposed within a sheath 25 of aerodynamically formed fabric or other material. Together, the sheath 25 and the spar 22 form left and right wings 12A and 12B. In certain embodiments, a laterally communicating pocket 27 can be sewn into the sheath 25 along the wings 12A and 12B to hold the spar 22 in position. The spar 22 can also be formed of spring steel with an arcuate cross section thereby to provide structural rigidity when extended but to permit a ready coiling of the same as disclosed herein. When unobstructed, the body member 10 and the spar 22 will tend to automatically achieve a straight configuration as shown, for example, in FIG. 1.

The body member 10 and the spar 22 can comprise flexible members that can be nondestructively rolled or coiled onto themselves. In certain embodiments, the body member 10 and the spar 22 can be formed from a metal, such as spring steel. The body member 10 and the spar 22 can be flat in cross section. Alternatively, they can be arcuate or otherwise profiled in cross section to provide enhanced structural integrity. In particular embodiments, the body member 10 and the spar 22 can be of nickel-coated spring steel or other metal or material having the ability to demonstrate rigidity when extended while permitting coiling to a collapsed configuration. For instance, the body member 10 and the spar 22 could be similar in material and shape to the tape portion of a coiled tape measure, the structures and variations thereof being well known to one knowledgeable in the art and within the scope of the invention.

When extended as in FIG. 1, the spar 22 and the enveloping sheath 25 of material can provide aerodynamic performance to the airplane 100 to support the airplane 100 during flight. The sheath 25 of the wings 12A and 12B can be made of any suitable material, including, by way of example, any natural or manmade fabric, vinyl, plastic, rubber, paper, rip-stop nylon, or any other effective material.

Again with reference to FIG. 1, a longitudinally communicating sleeve 20 can be formed, such as by sewing, in the sheath 25 centrally between the wings 12A and 12B to retain the wings 12A and 12B properly disposed and aligned with the body 10. Under such a construction, the body member 10 can slide into the sleeve 20 of the wings 12A and 12B and be permanently or removably retained in place relative to the spar 22 by any effective means, including adhesive, tape, buttons, pins, mechanical fasteners, such as rivets, sewing, and any other suitable method.

A tail 14 can be disposed at a posterior end of the body member 10. The tail 14 can be of any shape, size, and material. For example, the tail 14 could be a V tail, a twin tail, or any other shape and configuration. The tail 14 can be generally rigid, such as by being formed of plastic, or flexible, such as by being formed from coiling steel members. Alternatively or additionally, the tail 14 can incorporate padded or flexible material, such as sheet or molded foam. A nose 16 can be formed at the anterior end of the body member 10 and, like the tail 14, can be formed from any suitable material, including plastic, foam, and rubber. Still further, tip members 18A and 18B, which can be formed from any appropriate material and which can be rigid, semi-rigid, or otherwise formed, such as from rubber, plastic, foam, or any other material, can be disposed at the distal ends of the wings 12A and 12B.

The tail 14, nose 16, and tip members 18A and 18B can act as protection for the airplane 100, the surroundings, and bystanders. In certain embodiments, one or more of the tail 14, the nose 16, and the tip members 18A and 18B can be employed to affect the balance and aerodynamic performance of the airplane 100. For example, multiple, differently weighted, removable and replaceable tail 14, nose 16, and tip members 18A and 18B could be provided for being selectively employed. Additionally or alternatively, means can be provided for adding or subtracting weight in relation to one or more of the tail 14, nose 16, and tip members 18A and 18B.

Figure 2:
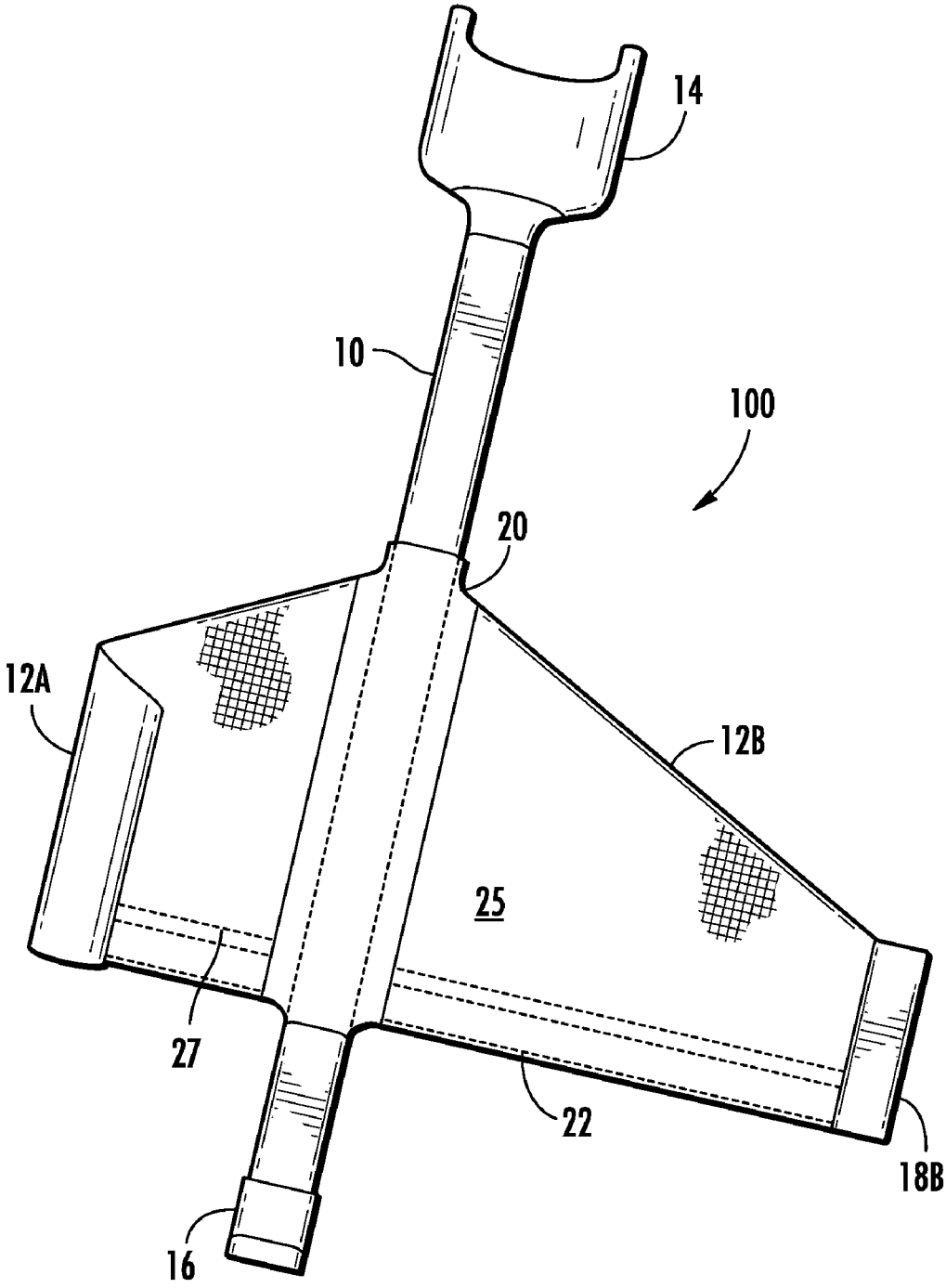
FIG. 2 is a perspective view of the collapsible toy airplane of FIG. 1 shown with the left wing partially rolled into the body.
Figure 3:
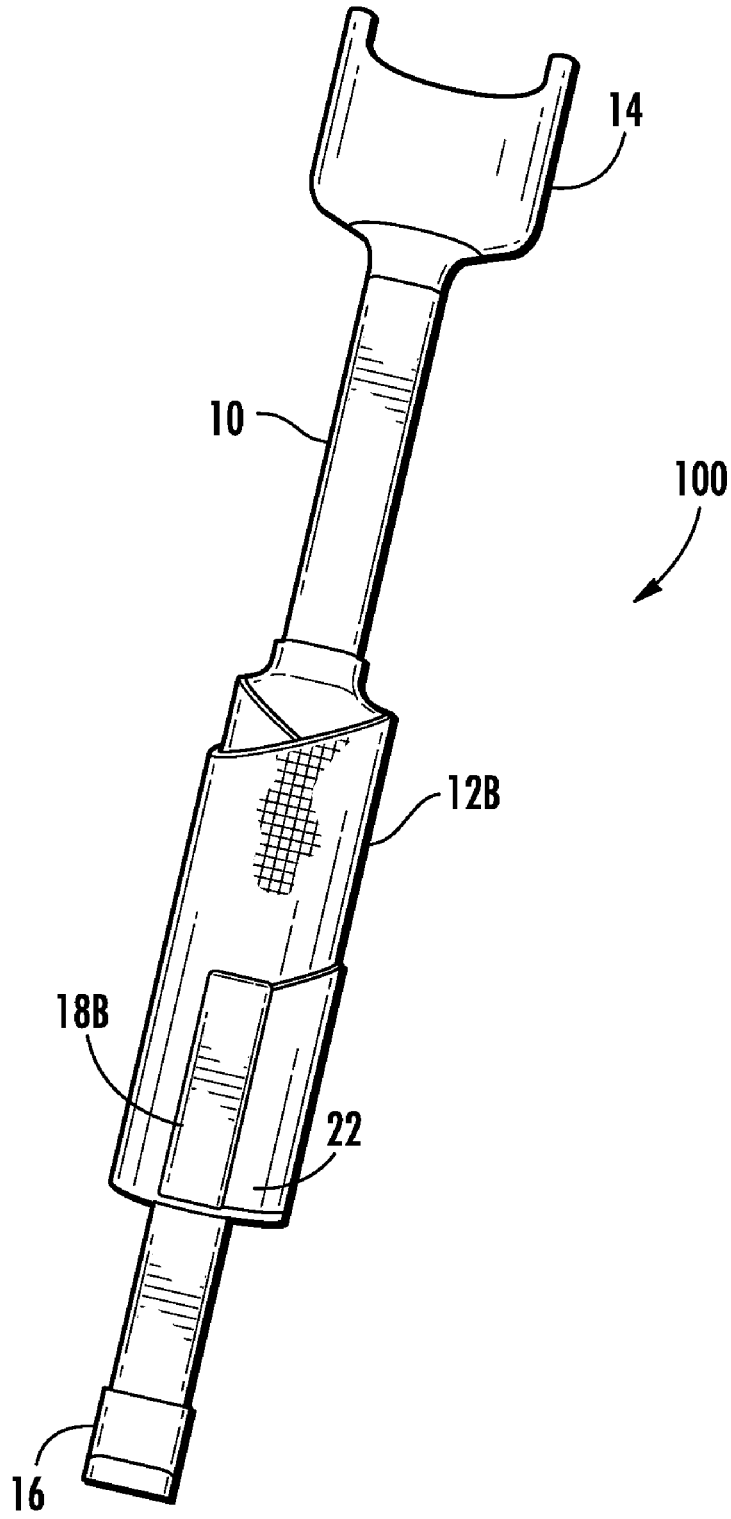
FIG. 3 is a perspective view of the collapsible toy airplane of FIG. 1 shown in a further collapsed configuration with both wings in coiled configurations.
Figure 4:
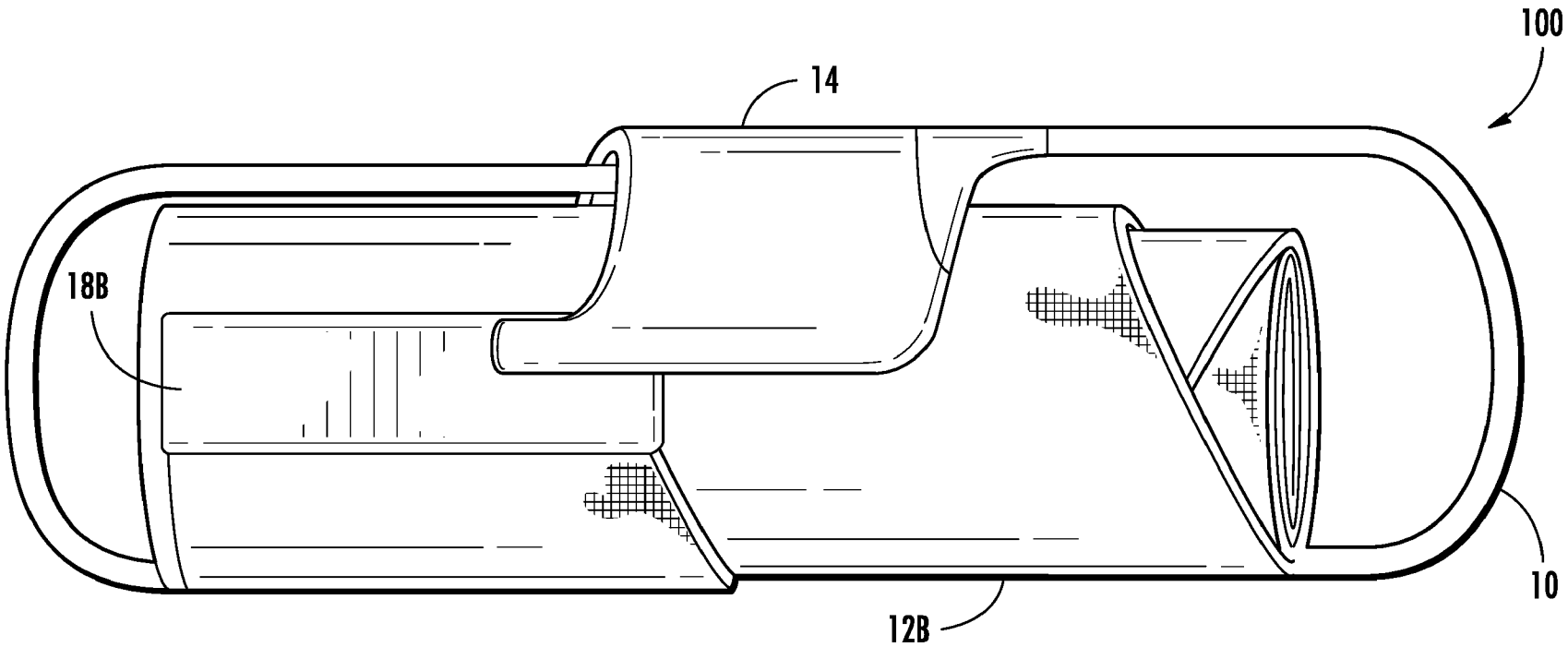
FIG. 4 is a perspective view of the collapsible toy airplane of FIG. 1 collapsed still further with the fuselage portion in a partially coiled configuration.
Figure 5:
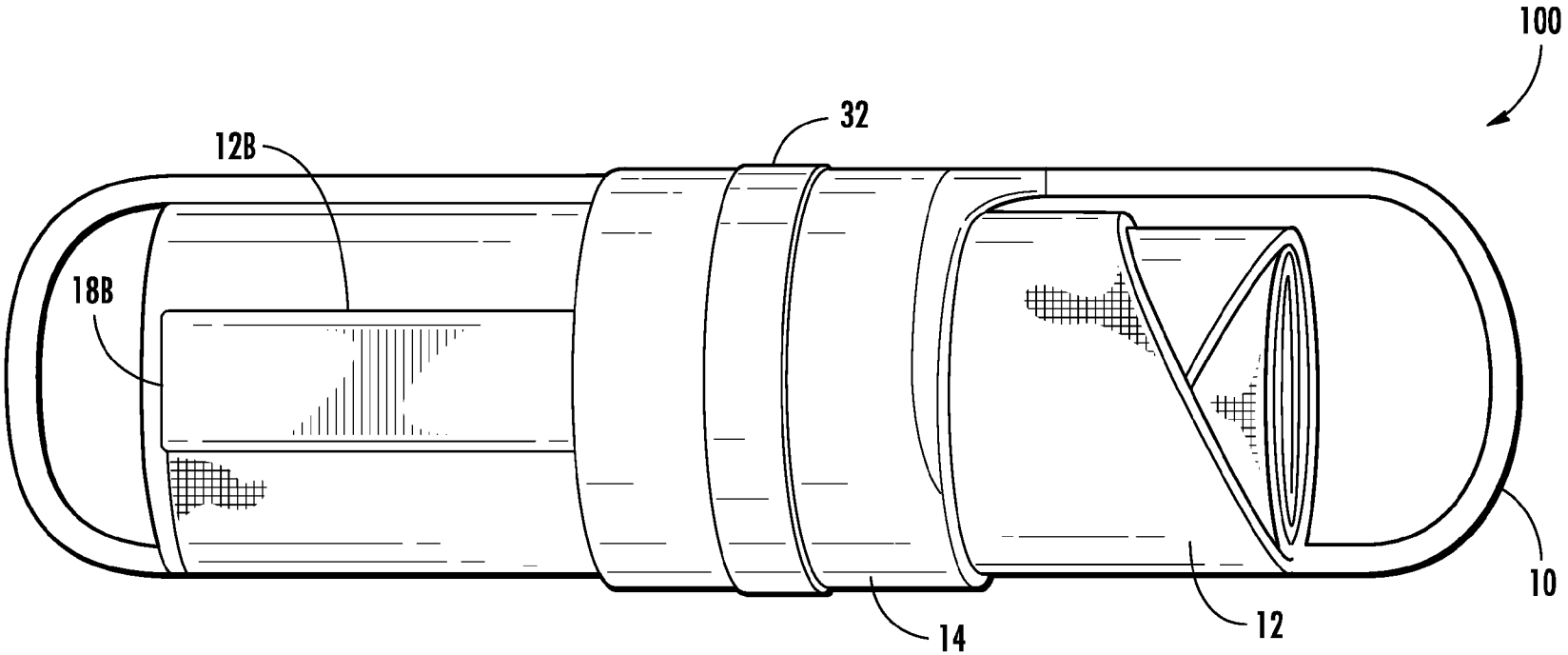
FIG. 5 is a view in side elevation of the collapsible toy airplane of FIG. 1 shown in a fully collapsed and folded configuration.

The airplane 100 can be collapsed in numerous different ways. By way of example, as FIG. 2 shows, one can begin by rolling the left wing 12A into the body member 10 until the wing 12A achieves a coiled configuration. Next, the right wing 12B can be rolled toward the body member 10 to achieve a coiled disposition as shown in FIG. 3. To further achieve a storage configuration, the body member 10 can be rolled into a coil from the nose 16 to the tail 14 to approximate the arrangement shown in FIG. 4 where the airplane 100 is nearly completely collapsed. As FIG. 5 shows, the tail 14 can then be wrapped around both the body member 10 and the wings 12A and 12B to produce a compact configuration.

The airplane 100 can remain in its storage configuration until it is again desired to be used. If necessary or desirable, the airplane 100 can be retained in its collapsed configuration by any suitable means, such as a casing, string, packaging, or a resilient band 32 as shown in FIG. 5. Alternatively, the collapsed airplane 100 can be retained within a tube (not shown) that could additionally be used as a tool to reconfigure the airplane 100 to the collapsed configuration. With this, the airplane 100 can be stored and transported in a far smaller configuration than has been achievable under removable and reconfigurable wing airplane arrangements. Furthermore, the spring-loaded nature of the body member 10 and the spar 22 can enable the plane 100 to be deployed immediately and automatically upon being freed of restriction, such as upon removal of the band 32, or upon removal from the tube. Furthermore, the airplane 100 could deploy to a use configuration upon being tossed in the air by a user. In other words, the airplane 100 could be tossed in the air while in a coiled or collapsed configuration whereupon it will automatically open to a use configuration based on the potential energy retained by the coiled body member 10, spar 22, and potentially other components.

In a further refinement of the invention, a winder mechanism can be provided, such as by being incorporated into the airplane 100. Under such an arrangement, the wings 12A and 12B can be unrolled from the body 10 as compared to being rolled from the wing tips 18A and 18B out. Furthermore, the wings 12A and 12B and, potentially, the body 10 can be rolled by hand as described or with the assistance of a rolling tube or other mechanism.

Embodiments of the airplane 100 can be designed merely for display or play while others can be designed for flight. Where the airplane 100 is designed for flight, propulsion can be facilitated by any reasonable means, whether by the application of external force and, additionally or alternatively, by an internal propulsion arrangement. As such, propulsion methods can, by way of example and not limitation, include hand launching, launching with a spring or rubber band, line launching, dropping from an elevated location, including from another airplane. Where internal propulsion is provided, the propulsion can, for example, be undertaken by ornithoptic flapping, by a propeller rotated or actuated by rubber band, battery, internal combustion engine, by compressed gas, or by rocket. The airplane 100 can fly without user control, by tethered control, by remote control, such as by radio or wireless communication, or even in a preprogrammed manner. In certain uses, the airplane 100 could be launched, such as by being thrown by hand or shot from a sling or the like, while in a collapsed configuration and can open automatically while in flight.

Figure 6:
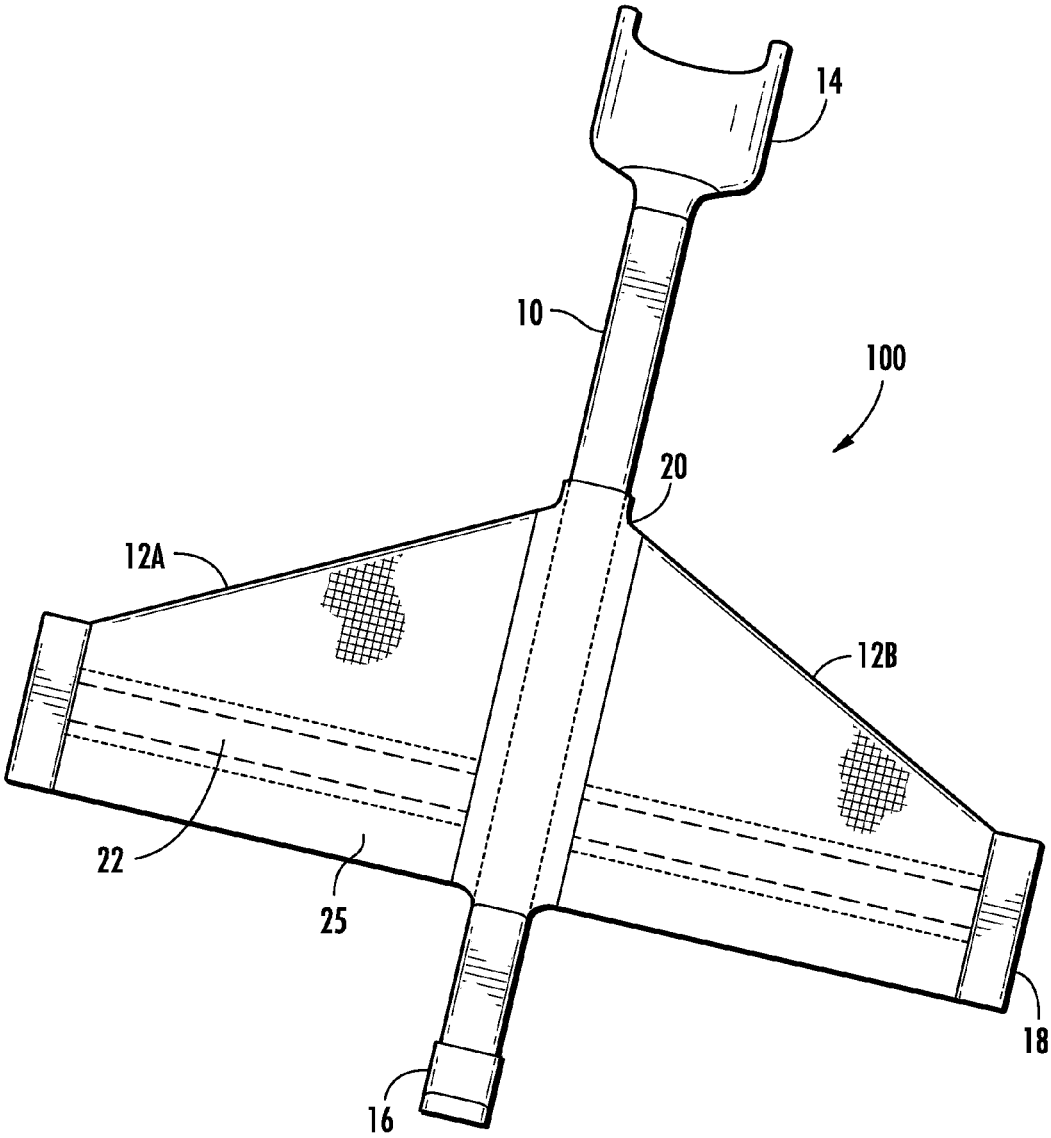
FIG. 6 is a perspective view of an alternative collapsible toy airplane in a use configuration.
Figure 7:
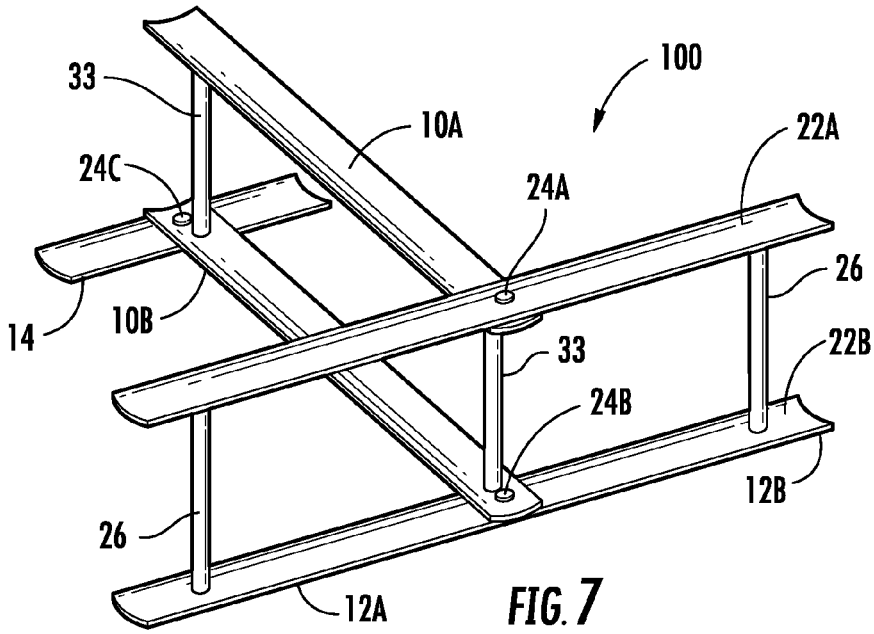
FIG. 7 is a perspective view of a further collapsible toy airplane as disclosed herein.
Figure 8:
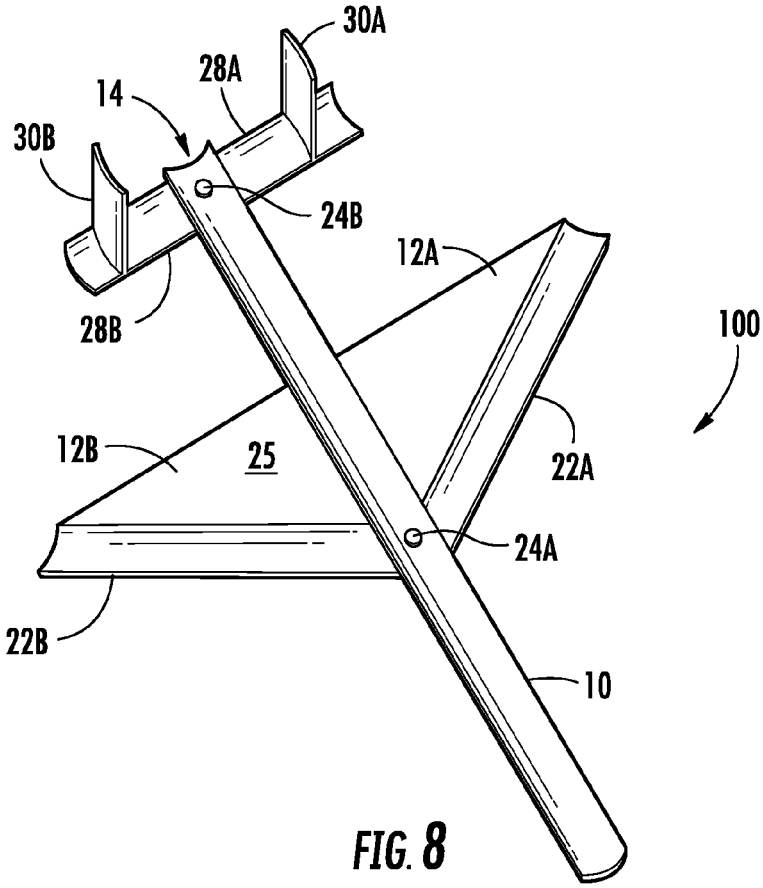
FIG. 8 is a perspective view of still another embodiment of the collapsible toy airplane of the present invention.

It will, of course, be appreciated that the configuration of FIGS. 1 through 5 is merely exemplary. Toy airplanes 100 under the present invention can be of nearly any size and shape. Airplanes 100 can be designed to simulate actual airplanes or can be entirely fanciful. For example, FIGS. 6 through 8 show further airplanes 100 in demonstration of the versatility of the invention. The alternative embodiment of FIG. 6 shows an airplane 100 again with a spar 22 disposed perpendicularly to a body 10. Again, the body 10 and the spar 22 can be formed from any suitable materials and, preferably, from a material, such as spring steel with an arcuate cross section, capable of being coiled without permanent deformation to enable the airplane 100 to be reconfigured between storage and use configurations in a non-destructive manner. The spar 22 can again be disposed within a pocket 27 sewn or otherwise formed in the sheath 25. In this embodiment, however, the spar 22 can be disposed toward the center of the sheath 25 of the wings 12A and 12B. The rigid or semi rigid wing tips 18A and 18B can provide added longitudinal rigidity and form to the wings 12A and 12B.

In the alternative embodiment of FIG. 7, the airplane 100 has upper and lower spars 22A and 22B perpendicularly retained by any suitable means or method relative to upper and lower body members 10A and 10B that form the fuselage of the airplane 100. The upper and lower spars 22A and 22B can be retained in a generally parallel or other disposition by any suitable means, such as stabilizer bars or tethers 26. Similarly, the upper and lower body members 10A and 10B can be retained in a desired relationship by stabilizer bars or tethers 33 or any other effective mechanism. A perpendicularly disposed tail 14, which can also be of a material capable of being coiled, can be retained adjacent to the posterior end of one or both of the upper and lower body members 10A and 10B. So configured, the upper and lower body members 10A and 10B, the upper and lower spars 22A and 22B, and the tail 14 can form the framework of a biplane 100. Where necessary or desirable, a skin, sheathing, or other materials can partially or completely envelope the framework to render the plane 100 aerodynamically sound and, additionally or alternatively, more aesthetically complete.

In certain embodiments of the invention, such as that shown in FIG. 7, the wing 12 or wings 12A and 12B and, potentially, the tail 14 can be pivotally retained relative to the body member 10 or the respective members 10A and 10B. In FIG. 7, the upper and lower spars 22A and 22B are pivotally coupled to the respective upper and lower body members 10A and 10B at pivot axes 24A and 24B. Similarly, the tail 14 could be pivotally coupled to the lower body member 10B at a pivot axis 24C. The pivot axes 24A, 24B, and 24C could be of any effective type, including rivets, threaded fasteners, or any other type of swivel connection that might now exist or hereafter be developed. With such a pivotable coupling of the wings 12A and 12B and the tail 14 with the body portions 10A and 10B, they can be pivoted between the use configuration shown in FIG. 7 and an in-line configuration where the wings 12A and 12B, the tail 14, and the body portions 10A and 10B are in longitudinal alignment. With that, the aligned wings 12A and 12B, tail 14, and body portions 10A and 10B can be readily coiled to achieve a fully collapsed, storage configuration.

In the even further embodiment of FIG. 8, one can see that the airplane 100 can have a framework that approximates the shape of a fighter jet, in this case an F-15 Eagle. With that, the left and right wings 12A and 12B can be framed by first and second spars 22A and 22B coupled to a mid-portion of the body member 10. The first and second spars 22A and 22B can be disposed at a relatively steep rake angle. A sheath 25 can partially or completely envelop the spars 22A and 22B to give left and right wings 12A and 12B approximating the shape and appearance of the wings of the fighter jet. The airplane 100 has a tail portion 14 formed by a laterally disposed, collapsible spar forming left and right horizontal stabilizers 28A and 28B and upstanding members forming left and right vertical stabilizers 30A and 30B.

The first and second spars 22A and 22B can be fixed in relation to the body portion 10 or pivotable about a pivot axis 24A. Likewise, the tail portion 14 can be fixed in relation to the body portion 10, or it can be pivotable about an aft pivot axis 24B. Where the first and second spars 22A and 22B and the tail portion 14 are pivotable in relation to the body portion 10, the collapsing of the plane 100 can be facilitated by pivoting the spars 22A and 22B and the tail portion 14 to a position in-line with or generally parallel in orientation with the body portion 10. With the spars 22A and 22B and the tail 14 pivoted as described, the airplane 100 can be coiled to a collapsed or storage configuration.

The foregoing and many further airplane designs are contemplated and within the scope of the invention. By way of example, wings can be disposed perpendicularly to the body member 10, at a dihedral angle, at an anhedral angle, regallo shaped, swept forward, or swept backward. The tail portion 14 can, for example, be a V Tail, a twin tail, a vertically disposed tail, or any other tail portion 14. As suggested above, the plane 100 can have a single layer of wings or can take the form of a biplane or tri-plane, or have even further wings. The invention can also be embodied as a kite or other flying device. Furthermore, airplanes 100 and other structures pursuant to the invention can be of substantially any size.

Figure 9:
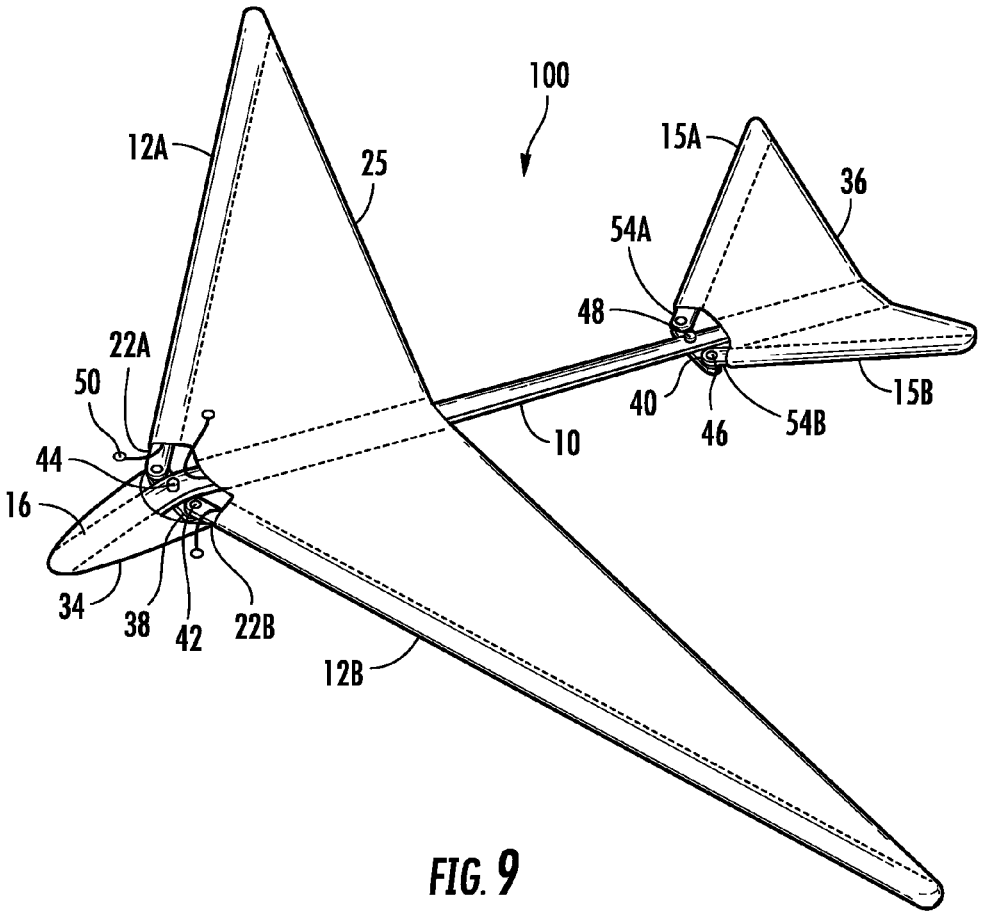
FIG. 9 is a perspective view of a collapsible toy airplane with pivoting wings pursuant to the invention.
Figure 10:
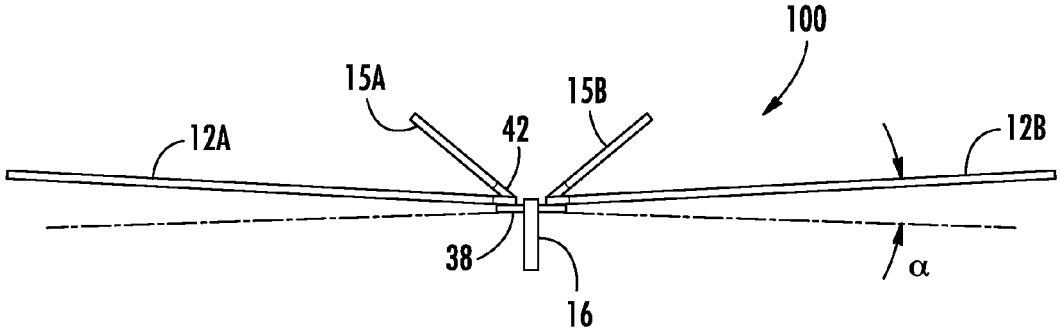
FIG. 10 is a view in front elevation of the collapsible toy airplane of FIG. 9.
Figure 11:
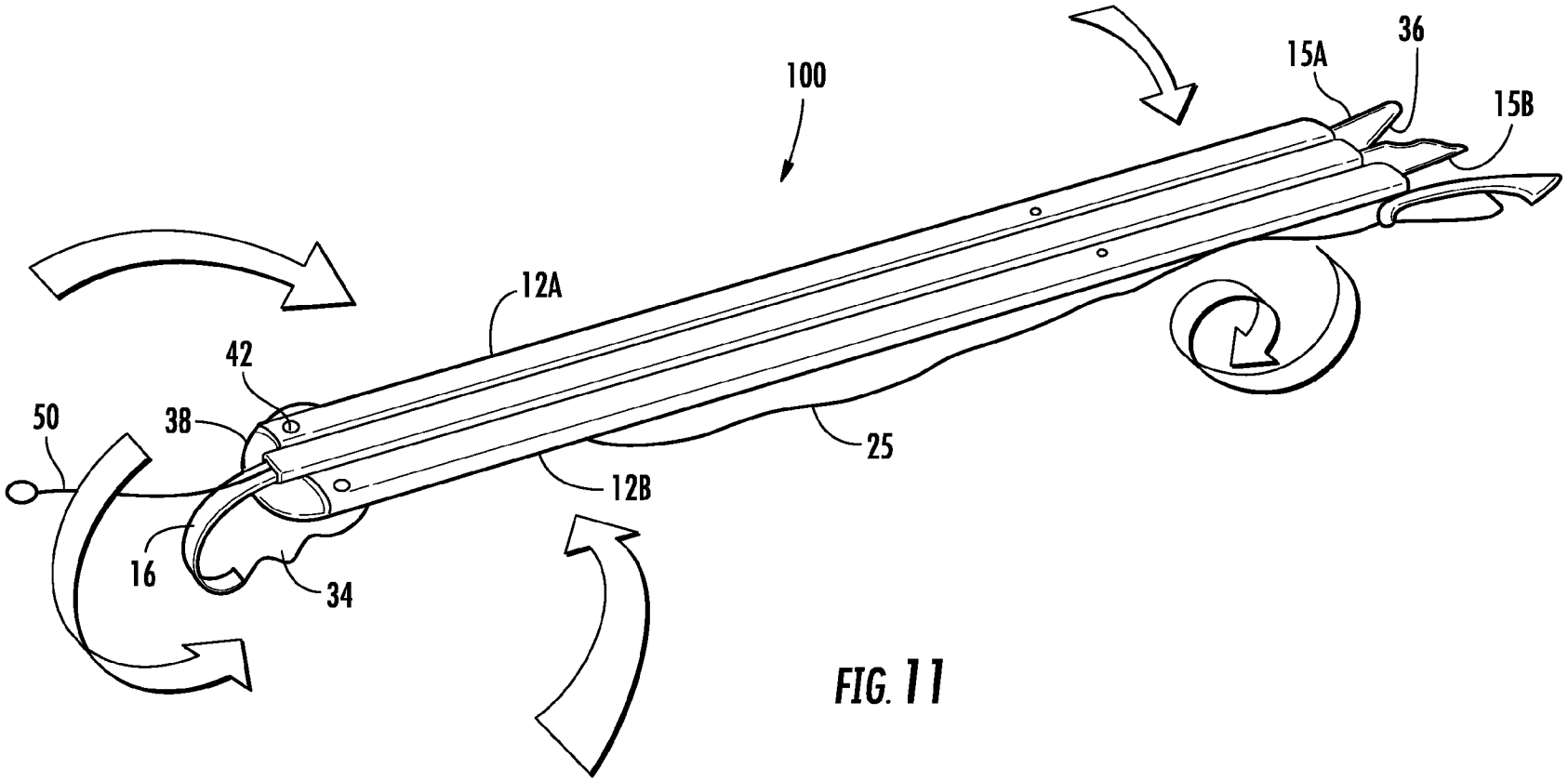
FIG. 11 is a perspective view of the collapsible toy airplane of FIG. 9 in an in-line configuration.

A further variation of the collapsible toy airplane 100 of the present invention is depicted in FIGS. 9 through 11. The airplane 100 is founded on a body portion 10. First and second forward spars 22A and 22B are pivotally coupled to the body portion 10. More particularly, each spar 22A and 22B has a proximal end pivotally retained by a pivot pin 42 to a front base plate 38, which is secured to a forward portion of the main body portion 10 by a retaining pin 44. In a similar manner, first and second rear spars 54A and 54B are pivotally coupled to an aft portion of the body portion 10 by a rearward base plate 40 that is fixed to the main body 10 by a retaining pin 48. The spars 22A, 22B, 54A, and 54B and the body portion 10 can again be formed form coilable lengths of material, such as spring steel, with an arcuate cross section.

A front wing sheath 25 envelops the first and second spars 22A and 22B and a forward segment of the body portion 10 to form first and second aerodynamic front wings 12A and 12B, and a rear wing sheath 36 envelops the first and second rear spars 54A and 54B and a rearward segment of the body portion 10 to form first and second rear wings 15A and 15B. As shown, pockets can be sewn or otherwise formed in the sheaths 25 and 36 to maintain the spars 22A, 22B, 54A, and 54B and the body portion 10 in position.

The airplane 16 can have a nose portion 16 forward of the front wings 12A and 12B. The nose portion 16 can be formed from a portion of the member forming the body portion 10, or it could comprise a separate member. The nose 16 can be downturned to aid in the aerodynamic stability of the airplane 100. For example, as shown in FIG. 9, a nose sheath 34 can envelop the forward end of the body portion 10 and can restrict that distal end from fully straightening. With that, the nose sheath 34 will likewise project downwardly in relation to the remainder of the body portion 10 thereby to form an aerodynamic and gravitational stabilizing member.

By use of the pivotable coupling to the front and rear base plates 38 and 40, the first and second spars 22A and 22B and thus the first and second wings 12A and 12B and the first and second rear spars 54A and 54B and thus the first and second rear wings 15A and 15B can be pivoted from the flight or use configuration shown, for example, in FIGS. 9 and 10, to the in-line configuration shown in FIG. 11 where the spars 22A and 22B and 54A and 54B are generally aligned with or in parallel to the body member 10. A number of additional means for accomplishing such a pivoting would be readily obvious to one skilled in the art after reading this disclosure. Each such means is within the scope of the present invention.

With the front and rear wings 12A, 12B, 15A, and 15B folded and the spars 22A and 22B and 54A and 54B aligned with the body member 10, each such member can be readily coiled simultaneously to bring the airplane 100 to a fully collapsed configuration. The spars 22A and 22B and 54A and 54B and the body member 10 can be rolled to a coiled configuration by hand as described previously or by using a tool, such as a cylinder.

Figure 14:
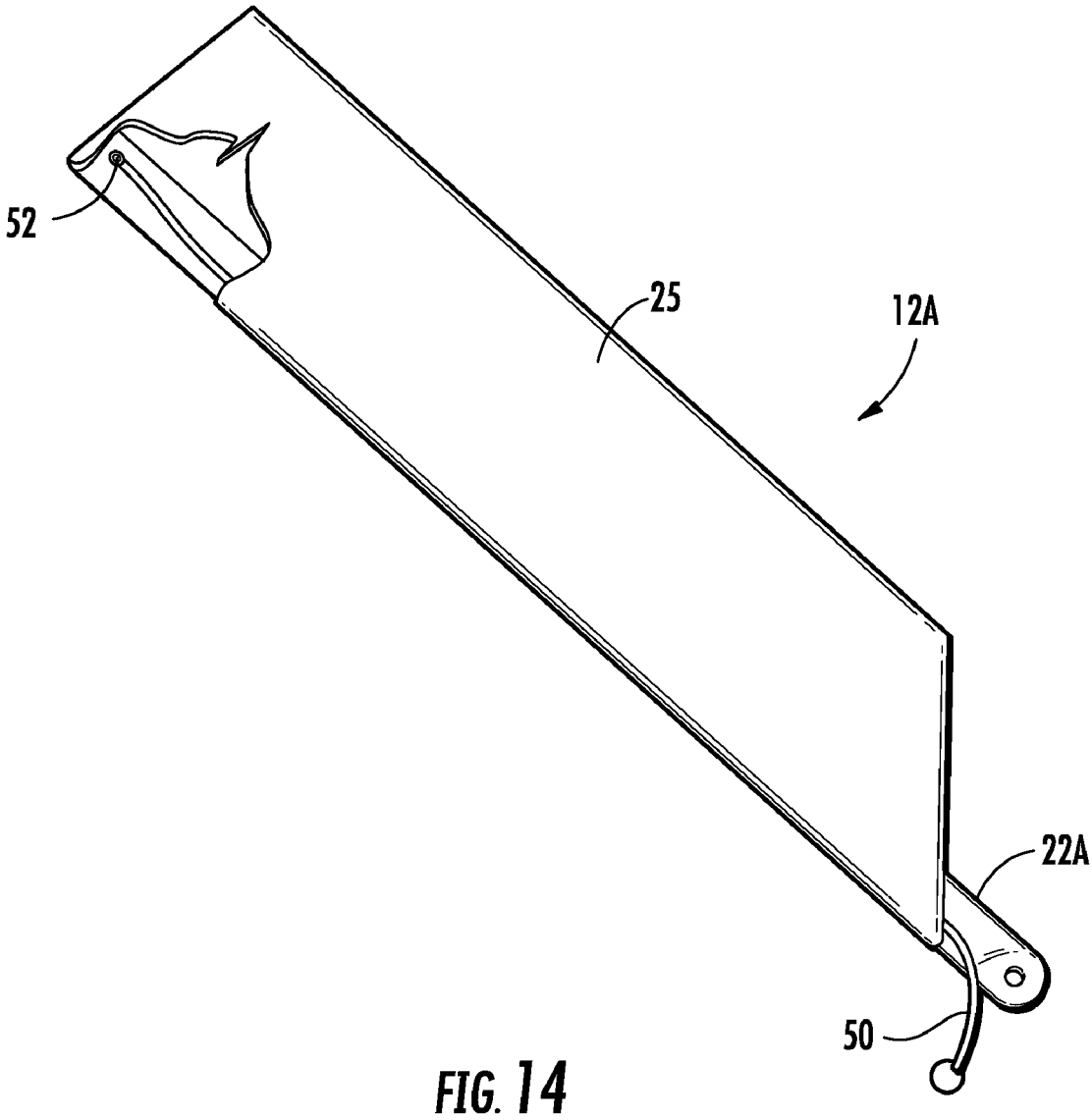
FIG. 14 is a view in top elevation of a wing structure with a drawstring collapsing mechanism.

In one contemplated embodiment, however, one or more of the spars 22A and 22B and 54A and 54B and the body member 10 can be drawn to a coiled configuration by a drawstring 50 with a first end secured to an end of the spar 22A, 22B, 54A, or 54B or the body member 10, a body portion passing within the sheath 25 or 36, and a second end extending outwardly from the sheath 25 or 36 adjacent to the opposite end of the spar 22A, 22B, 54A, or 54B or the body member 10. Such an arrangement is shown in relation to the first wing 12A in FIG. 14 where the drawstring 50 has a first end coupled to the distal end of the spar 22A at a coupling 52, a body portion passing within the sheath 25, and a second end extending from within the sheath 25. As shown in FIG. 9, a drawstring 50 could be associated with each of the spars 22A and 22B and the body portion 10. Under this arrangement, with the airplane 100 in an in-line configuration, the drawstrings 50 can be pulled to induce the spars 22A, 22B, 54A, and 54B and the body member 10 to a coiled configuration.

As can be best perceived by reference to FIG. 10, the front wings 12A and 12B can be retained at a dihedral angle $\alpha$ when the airplane 100 is in a use configuration to further enhance the flight characteristics and realistic appearance of the airplane 100. The rear wings 15A and 15B can likewise be disposed at a dihedral angle, which can be steeper than the dihedral angle $\alpha$.

Figure 12:
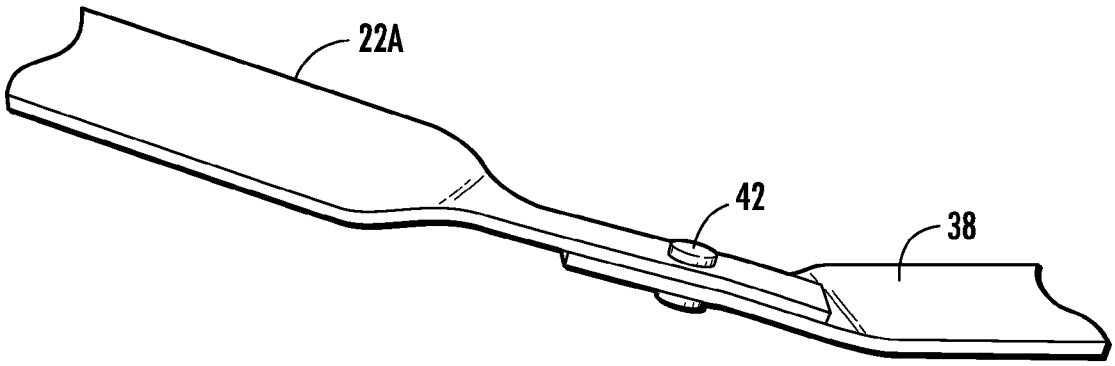
FIG. 12 is a perspective view of a base plate and pivotable wing in a use configuration.
Figure 13:
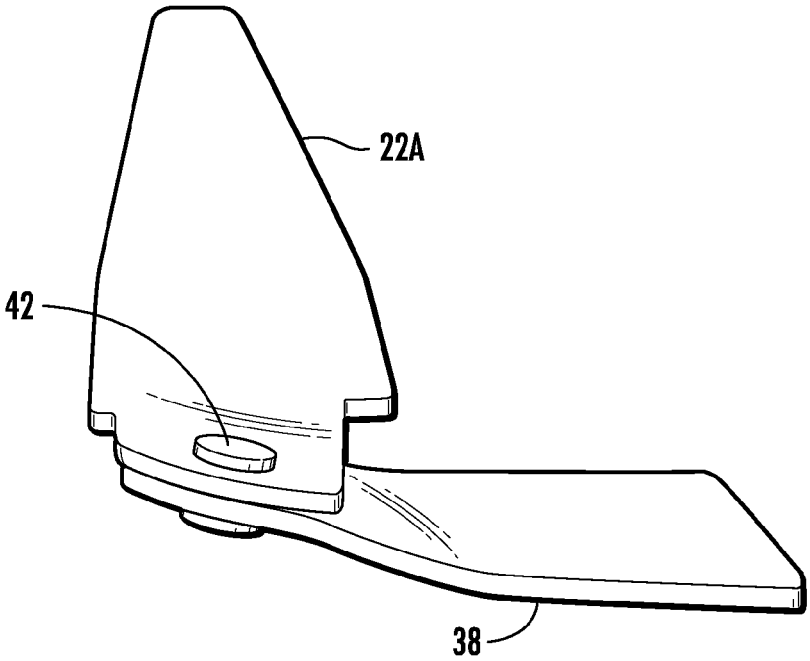
FIG. 13 is a perspective view of the base plate and pivotable wing in a pivoted, in-line configuration.

While the dihedral angles are advantageous to the performance and appearance of the airplane 100, it is also advantageous to permitting a collapsing of the airplane 100 to have the spars 22A and 22B and 54A and 54B generally aligned with or in parallel to the body member 10 when the wings 12A, 12B, 15A, and 15B are pivoted to a collapsed configuration as in FIG. 11. Under embodiments of the invention, both goals can be achieved in the wings 12A, 12B, 15A, and 15B by the pivoting arrangement shown in FIGS. 12 and 13 in relation to the spar 22A of the first wing 12A. There, the outboard end of the forward base plate 38 is upturned and it and the proximal end of the spar 22A have what can be considered a rearward bend. With this, when the spar 22A is in an extended, use configuration as in FIG. 12, the spar 22A and thus the wing 12A will be disposed at a dihedral angle. When the spar 22 is pivoted to an in-line disposition as in FIG. 13, the rearward bends of the spar 22A and the forward base plate 38 cooperate to bring the body portion of the spar 22A to the desired in-line configuration.

With certain details of the present invention for a collapsible toy airplane 100 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A collapsible toy airplane nondestructively and repeatably reconfigurable between a storage configuration and a use configuration, the toy airplane comprising:

a fuselage comprising an elongate main body member with a forward end, an aft end, and a body portion wherein the elongate main body member forms substantially the entire fuselage, wherein the forward end of the elongate main body member forms a forward end of the fuselage, wherein the aft end of the elongate main body member forms an aft end of the fuselage, and wherein substantially the entire elongate main body member has an arcuate cross section and is formed from a spring material that is reconfigurable between a use configuration wherein the elongate main body member is substantially straight and a coiled configuration wherein the elongate main body member is coiled;

first and second wings coupled to the fuselage wherein each wing has a proximal end and a distal end and wherein the first and second wings are formed by at least one spar member wherein substantially the entire at least one spar member that forms the first and second wings has an arcuate cross section and is formed from a spring material that is reconfigurable between a use configuration wherein the at least one spar member is substantially straight and a coiled configuration wherein the at least one spar member is coiled;

wherein the elongate body member and the at least one spar member automatically open to a use configuration from their coiled configurations;

whereby the entire fuselage and the entire at least one spar member are nondestructively and repeatably reconfigurable between a first, use configuration where the entire fuselage is substantially straight and the entire at least one spar member is substantially straight and a second, coiled configuration wherein the entire fuselage is coiled and the at least entire spar member is coiled.

2. The collapsible toy airplane of claim 1 wherein the main body member and the at least one spar member are formed from spring steel.

3. The collapsible toy airplane of claim 1 further comprising a sheath of flexible material that at least partially envelops the at least one spar member and further comprising a drawstring for drawing the at least one spar member to a coiled configuration wherein the drawstring has a first end coupled to a first end of the at least one spar member, a body portion that passes within the sheath of flexible material, and a second end that extends beyond the sheath of flexible material adjacent to a second end of the spar member whereby the second end of the drawstring can be pulled thereby to pull on the second end of the spar member to induce the at least one spar member to a coiled configuration.

4. The collapsible toy airplane of claim 1 further comprising a sheath of flexible material that at least partially envelops the at least one spar member.

5. The collapsible toy airplane of claim 1 further comprising tip members removably and replaceably retained relative to the distal ends of the first and second wings for enabling an adjustment of balance in the collapsible toy airplane.

6. The collapsible toy airplane of claim 5 further comprising a nose member removably and replaceably retained relative to the forward end of the fuselage.

7. The collapsible toy airplane of claim 1 wherein the at least one spar member is pivotable about a pivot axis in relation to the main body member.

8. The collapsible toy airplane of claim 7 wherein the at least one spar member is pivotable from a use configuration wherein the at least one spar member forms the first and second wings and an in-line configuration wherein the at least one spar member is substantially in-line with the main body member.

9. The collapsible toy airplane of claim 8 wherein the first wing is formed from a first spar, wherein the second wing is formed from a second spar, wherein each of the first and second spars has a proximal end and a distal end, and wherein each of the first and second spars is pivotally coupled to the main body portion at a pivot axis whereby the first and second spars can be pivoted from a use configuration wherein the first and second spars respectively form the first and second wings and an in-line configuration wherein the first and second spars are substantially in-line with the main body member.

10. The collapsible toy airplane of claim 9 wherein the first and second spars are disposed at a dihedral angle relative to the body portion when in a use configuration.

11. The collapsible toy airplane of claim 10 wherein the first and second spars are pivotally coupled to the main body portion by a base plate that has a mid-portion coupled to the main body portion, a first outboard end pivotally coupled to the first spar member, and a second outboard portion pivotally coupled to the second spar member.

12. The collapsible toy airplane of claim 11 wherein each of the first and second outboard ends of the base plate and the proximal ends of the first and second spars has a rearward bend.

13. The collapsible toy airplane of claim 12 wherein the first and second outboard ends of the base plate are upturned.

14. The collapsible toy airplane of claim 1 wherein the forward end of the fuselage projects anteriorly to the first and second wings to form a nose and further comprising a sheath of flexible material at least partially envelops the nose wherein the sheath of flexible material retains the nose in a downturned configuration while the airplane is in a use configuration.

* * * * *